United States Patent [19]

Watanabe

[11] Patent Number: 4,683,621

[45] Date of Patent: Aug. 4, 1987

[54] FLEXIBLE BUTTON

[75] Inventor: Hirokazu Watanabe, Kurobe, Japan

[73] Assignee: Nippon Notion Kogyo Co., Ltd., Tokyo, Japan

[21] Appl. No.: 782,589

[22] Filed: Oct. 1, 1985

[30] Foreign Application Priority Data

Oct. 2, 1984 [JP] Japan ..... 59-149216[U]

[51] Int. Cl.[4] ..... A44B 1/42

[52] U.S. Cl. ..... 24/95; 24/92; 24/113 R

[58] Field of Search ..... 24/90 C, 90 E, 94, 95, 24/113 MP, 92, 108, 113 R, 620, 621, 691

[56] References Cited

U.S. PATENT DOCUMENTS

| | | | |
|---|---|---|---|
| 691,178 | 1/1902 | Richmond | 24/95 |
| 1,601,933 | 10/1926 | Warner | 24/95 |
| 1,800,767 | 4/1931 | White et al. | 24/95 |
| 2,067,223 | 1/1937 | Janes | 24/95 X |
| 2,179,032 | 11/1939 | Carley et al. | 24/95 |
| 2,520,781 | 8/1950 | Poupitch | 24/95 |
| 2,825,951 | 3/1958 | Chaves | 24/113 R X |
| 4,481,696 | 11/1984 | Kanazaka | 24/92 X |

FOREIGN PATENT DOCUMENTS

| | | |
|---|---|---|
| 54-4640 | 1/1979 | Japan . |
| 59-128209 | 8/1984 | Japan . |

*Primary Examiner*—Kenneth J. Dorner
*Assistant Examiner*—Laurie K. Cranmer
*Attorney, Agent, or Firm*—Hill, Van Santen, Steadman & Simpson

[57] ABSTRACT

A tiltable button has a two-piece interior part of rigid material including a disk-like member non-turnably held between a cap and a button back, and a separate socket member extending through a hollow hub of the button back and joined with a tack member with a garment fabric therebetween. The disk-like member has at least one unyielding off-center leg. The socket member has a collar portion which is loosely received in the hollow hub and through which collar portion there extends at least one groove receptive of the leg so that the disk-like member and hence the button body can be manually tilted with respect to the axis of the socket member but are prevented from turning about their own common axis.

6 Claims, 9 Drawing Figures

FLEXIBLE BUTTON

BACKGROUND OF THE INVENTION

1. Field of Invention

The present invention relates to a button including a button body and a tack member adapted to be joined with the button body for attachment of the button to a garment fabric.

2. Description of the Prior Art

Various buttons are known which generally comprise a button body and a tack member adapted to be joined with the button body for attachment of the button to a garment fabric. In this attaching, a tapering end of the shank of the tack member is caused to pierce through the garment fabric and is then forced into a hollow hub of the button body so as to deform the tapering end of the shank, thus securing the latter to the hollow hub of the button body. Since a head of the button body is not tiltable with respect to the hollow hub and hence the garment fabric, the button body must be tilted together with a portion of the garment fabric as the button is threaded through and removed from a button hole in the garment. Consequently, this prior art button is not suitable for a garment of denim, which is thick and very less flexible.

Japanese Patent Laid-Open Publication (Tokkaisho) No. 54-4640 discloses a button in which a head of a button body has a spherical projection pivotably received in a fixed hollow hub and is hence tiltable with respect to the hollow hub and hence a garment fabric. However, since the head tends to rotate or turn on its own axis, this prior art button is no longer useful where the head bears on its face a design or emblem requiring of a direction in which the head must be oriented.

To this end, an improvement has been proposed in Japanese Utility Model Laid-Open Publication (Jikkaisho) No. 59-128209, in which a button has a unitary interior member of thermoplastic synthetic resin received in a button body. The interior member includes a disk-like portion non-turnably interposed between a cap and a button back of the button body, a socket portion joined with a tack member with a garment fabric sandwiched therebetween, and a resilient connecting portion in the form of a pair of elongate planar webs extending between the disk-like portion and the socket portion and normally urging the disk-like portion to lie perpendicularly to the socket portion. The connecting portion is bendable so that the disk-like portion and hence the button body can be manually tilted with respect to the axis of the socket portion and hence the garment fabric, without being rotated or turned on their own common axis. However, because it is made of resilient synthetic resin, the connecting portion is liable to become ruptured or otherwise damaged, thus making the button less durable.

SUMMARY OF THE INVENTION

According to the present invention, a button has a two-piece interior part of substantially rigid material. The interior part includes a disk-like member non-turnably held between the cap and the button back, and a separate socket member extending through a hollow hub of the button back and joined with a tack member with a garment fabric sandwiched therebetween. The disk-like member has at least one unyielding off-center leg projecting from the rear surface of the disk-like member. The socket member has a collar portion which is loosely received in the hollow hub and through which collar portion there extends at least one groove receptive of the leg so that the disk-like member and hence the button body can be mannually tilted with respect to the axis of the socket member but are prevented from turning about their own common axis.

It is therefore an object of the invention to provide a button in which a button body can be manually tilted with respect to the axis of a tack member without turning about its own axis and in which an interior part of the button body is mechanically strong and hence free from risk of rupture or other damage, thus guaranteeing an extended life of the button.

Another object of the invention is to provide a button which is particularly useful where a head of the button bears on its face a design or emblem requiring a direction in which the head must be oriented.

Many other advantages, features and additional objects of the present invention will become manifest to those versed in the art upon making reference to the detailed description and the accompanying drawings in which a preferred structural embodiment incorporating the principles of the present inventions is shown by way of illustrative example.

DETAILED DESCRIPTION

Figure 1:
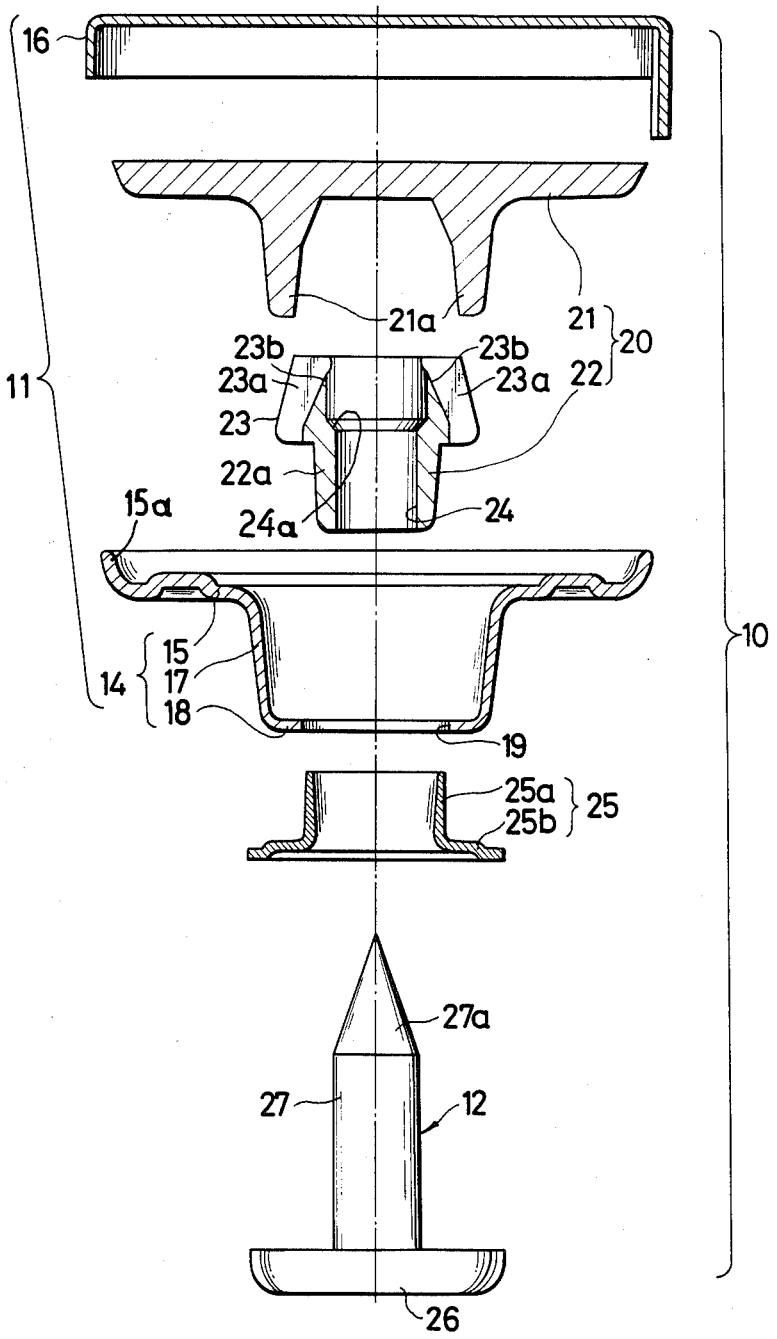
FIG. 1 is an exploded vertical cross-sectional view of a button embodying the present invention, with only a tack member not in cross section.
Figure 2:
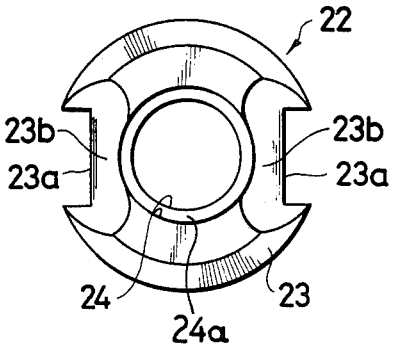
FIG. 2 is a plan view of a socket member.
Figure 3:
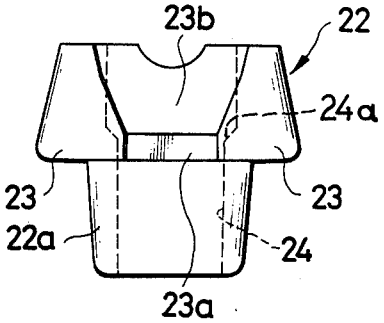
FIG. 3 is a side elevational view of FIG. 2.
Figure 4:
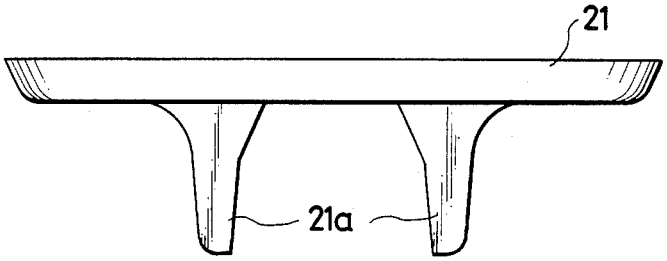
FIG. 4 is a top view of a disk-like member.
Figure 5:
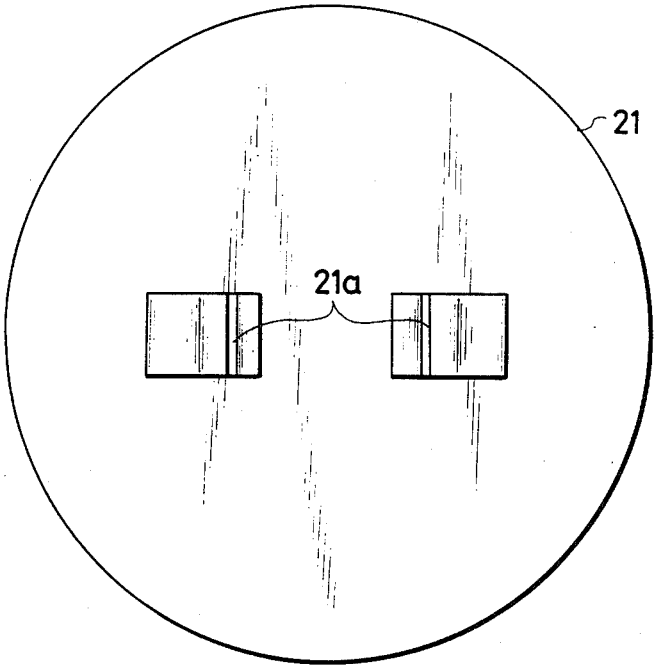
FIG. 5 is a bottom view of FIG. 4.
Figure 6:
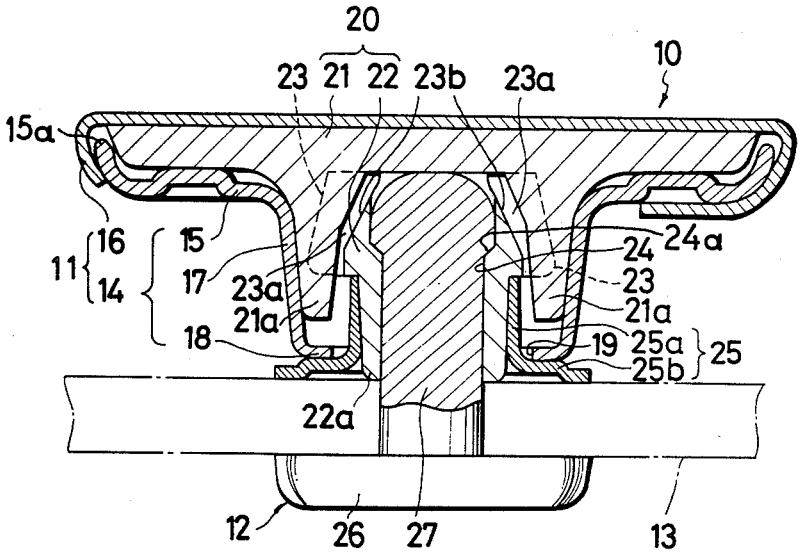
FIG. 6 is an elevational view, partially in cross section, of the button having been attached to a garment fabric.

The present invention is particularly useful when embodied in a button such as shown in FIGS. 1 and 6, generally indicated by the numeral 10.

Figure 7:
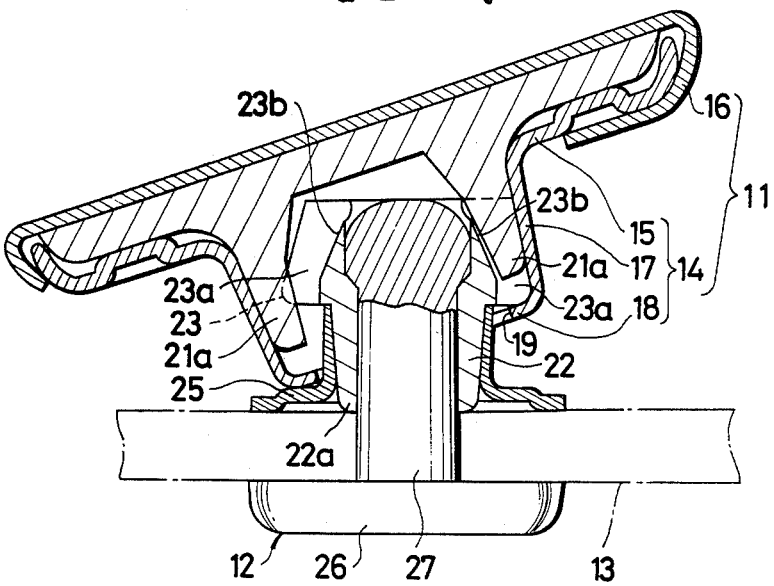
FIG. 7 is a view similar to FIG. 6, showing a button body in tilted position.

The button 10 generally comprises a button body 11 and a tack member 12 (joined with the button body 11 as shown in FIGS. 6 and 7), attaching the button 10 to a garment fabric 13.

As shown in FIGS. 1 and 6, the button body 11 includes a button back 14 having an upper annular flange (hereinafter referred to as "first flange") 15 having an annular rim 15*a* covered by a cap 16. The button back 14 also has a hollow hub 17 of circular cross section projecting downwardly from an inner edge of the first flange 15 and terminating in an inwardly directed lower annular flange (hereinafter referred to as "second flange") 18 defining a central aperture 19. The button back 14 and the cap 16 are made of metal.

A two-piece interior part 20 (FIGS. 1–7) includes a disk-like member 21 non-turnably held between the cap 16 and the second flange 18 of the button back 14, and a socket member 22 separate from the disk-like member 21 and extending through the hollow hub 17 of the button back 14. The disk-like member 21 has a pair of diametrically opposed off-center legs 21*a*, 21*a* projecting substantially perpendicularly from a bottom surface of the disk-like member 21. The socket member 22 has a collar portion 23 loosely received in the hollow hub 17 of the button back 14, the remaining collar-free portion 22*a* projecting downwardly through the central aperture 19 defined by the second flange 18. The socket member 22 has an axial through-hole 24 extending through both the collar and collar-free portions 23, 22*a* and having an upwardly divergent stepped portion 24*a* (for a purpose described below). The socket member 22 also has in and through the collar portion 23 a pair of diametrically opposed grooves 23*a*, 23*a* receiving therethrough the respective legs 21*a*, 21*a* so that the disk-like member 21 and hence the button body 11 can be manually tilted with respect to the axis of the socket member 22 but are prevented from turning about their own common axis, as described below in connection with FIG. 7. Each of the grooves 23*a*, 23*a* has a sloping bed surface 23*b* which is engageable with a respective one of the legs 21*a*, 21*a*, when the button body 11 is tilted on the socket member 22, to assist in restricting the amount of tilting of the button body 11.

In the illustrated embodiment, the disk-like member 21 and the socket member 22 are made of metal such as brass or iron. Alternatively, the socket member 22 may be made of thermoplastic synthetic resin.

An eyelet member 25 (FIGS. 1, 6 and 7) includes a tube 25*a* of metal non-turnably mounted on the socket member 22, covering the collar-free portion of the socket member 22. The tube 25*a* has at its lower end an outwardly directed flange (hereinafter referred to as "third flange") 25*b*.

As shown in FIGS. 1, 6 and 7, the tack member 12, which is preferably of metal, includes a head 26 and a central shank 27 of circular cross section projecting perpendicularly from one face of the head 26. In use, the shank 27 is caused to pierce through the garment fabric 13 and is then inserted through the axial through-hole 24 of the socket member 22. With continued insertion of the shank 27, the tapering end portion 27*a* is deformed in the axial through-hole 24 so as to permanently join the shank 27 of the tack member 12 with the socket member 22, the garment fabric 13 being sandwiched between the eyelet member's third flange 25*b* and the tack member's head 26. At that time, the stepped portion 24*a* of the axial through-hole 24 serves to prevent the shank 27 of the tack member 12 from being removed from the axial through-hole 24. The deformed end portion 27*a* of the shank 27 is received in the axial through-hole 24 so as not extend beyond the upper end thereof. Thus the tack member 12 is non-turnably joined with the button body 11, attaching the button 10 to the garment fabric 13.

In FIG. 6, for instance, if the left edge portion of the button body 11 is manually pushed downwardly, or if the right edge portion of the button body 11 is manually pulled upwardly, the button body 11 and thus the disk-like member 21 are tilted with respect to the axis of the socket member 22 and thus the garment fabric 13, as shown in FIG. 7. During that time, both the button body 11 and the disk-like member 21 are kept from being rotated or turned on their own axis, partly because the button body 11 and the eyelet member 25 are non-turnably joined with the disk-like and socket members 21, 22, respectively, of the interior part 20, and partly because the two off-center unyielding legs 21*a*, 21*a* of the disk-like member 21 project through the respective grooves 23*a*, 23*a* disposed in the collar portion 23 of the socket member 22.

In its tilted position, the button body 11 can be threaded through and removed from a button hole (not shown) in the garment with ease. Since the button body 11 and the cap 16 are non-turnable on their own common axis, the button 10 is particularly useful when the cap 16 bears on its top a design or emblem requiring of a direction in which the button 10 must be oriented.

Partly because the interior part 20 is divided into two separate members, i.e. the disk-like and socket members 21, 22, and partly because at least the disk-like member 21 is made of metal, the interior part 20 is mechanically strong and is hence free from risk of rupture or other damage, thus guaranteeing an extended life of the button 10.

Figure 8:
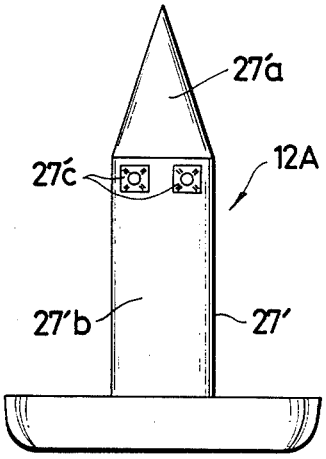
FIGS. 8 and 9 show alternative forms of tack members.
Figure 9:
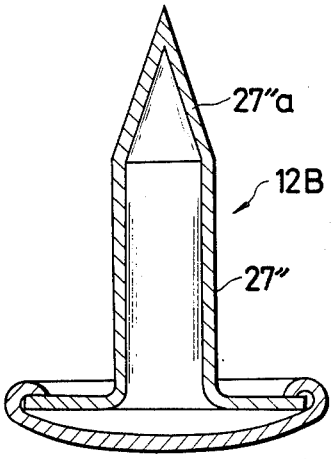

FIGS. 8 and 9 illustrate alternative forms of tack members 12A, 12B. In the tack member 12A of FIG. 8, a solid shank 27' has a pair of recesses 27'*c*, 27'*c* immediately below or adjacent to the border between a tapering end portion 27'*a* and a stem portion 27'*b*. When the shank 27' is fully inserted through the socket member 22, the tapering end portion 27'*a* is bent about the recesses 27'*c*, 27'*c* as its distal end is forced against the bottom surface of the disk-like member 21. The recesses 27'*c*, 27'*c* serve to assist in bending the tapering end portion 27'*a*. The tack member 12B of FIG. 9 has a hollow shank 27'', a tapering end portion 27''*a* of which is bendable or otherwise deformable when the shank 27'' is fully inserted through the socket member 22.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A button for attachment to a garment fabric, comprising:

(a) a button body including a button back and a cap covering said button back on one side to face away from the fabric, said button back including a hollow hub disposed remotely from said cap and extending perpendicularly to and centrally of said cap, said hollow hub having at its one end an annular flange defining a central aperture;

(b) a two-piece interior part including a disk-like member non-turnably held between said cap and said button back, and a socket member with an axis and separate from said disk-like member, said socket member having a collar portion loosely received in said hollow hub and engageable with said annular flange so as not to be removed from said hollow hub, and a collar-free portion extending through said central aperture, said socket member having an axial through-hole extending through both said collar and collar-free portions, said disk-like member having at least one off-center unyielding leg projecting from said disk-like member, said socket member having in and through said collar portion at least one peripheral groove receiving said leg therethrough, said groove having a sloping bed surface along which said leg is slidable to be tilted with respect to the axis of said socket member;

(c) an eyelet member non-turnably mounted on said socket member and having a tube covering said collar-free portion of said socket member and loosely received in said central aperture of said hollow hub; and (d) a tack member including a head and a central shank projecting perpendicularly from said head for reception into said axial through-hole of said socket member and adapted to be non-removably deformed in said axial through-hole.

2. A button according to claim 1, said disk-like member comprising metal.

3. A button according to claim 2, said socket member comprising metal.

4. A button according to claim 2, said socket member comprising thermoplastic synthetic resin.

5. A button according to claim 1, said at least one leg of said disk-like member being two diametrically opposed legs, said at least one groove in said socket member being two diametrically opposed grooves.

6. A button according to claim 1, said axial through-hole, having a stepped portion.

* * * * *